US005328266A

United States Patent [19]

Davis

[11] Patent Number: 5,328,266

[45] Date of Patent: Jul. 12, 1994

[54] EXTENSIBLE HANDLE BAG APPARATUS

[75] Inventor: Tommy L. Davis, Chicago, Ill.

[73] Assignee: Stone Container Corporation, Chicago, Ill.

[21] Appl. No.: 900,941

[22] Filed: Jun. 17, 1992

[51] Int. Cl.[5] ..... B65D 33/06

[52] U.S. Cl. ..... 383/14; 383/20; 383/24; 383/28

[58] Field of Search ..... 383/14, 17, 20, 24, 383/28, 25, 13, 118, 6

[56] References Cited

U.S. PATENT DOCUMENTS

| | | | |
|---|---|---|---|
| 2,469,536 | 5/1949 | Winesett | 93/35 |
| 2,603,407 | 7/1952 | Crary | 383/14 |
| 2,625,318 | 1/1953 | Ross | 383/14 |
| 2,838,224 | 6/1958 | Steen | 229/54 |
| 2,980,312 | 4/1961 | Gould | 383/20 |
| 2,985,355 | 5/1961 | Read | 383/14 X |
| 3,142,435 | 7/1964 | Strange et al. | 383/14 X |
| 3,145,908 | 8/1964 | Smith | 383/20 |
| 3,439,591 | 4/1969 | Class | 93/35 |
| 3,722,377 | 3/1973 | Hayes | 383/14 X |
| 4,691,369 | 9/1987 | Costa | 383/17 |
| 4,902,140 | 2/1990 | Branson | 383/25 |
| 5,059,033 | 10/1991 | Branson | 383/13 |

FOREIGN PATENT DOCUMENTS

| | | | |
|---|---|---|---|
| 6607941 | 6/1966 | Netherlands | 229/54 |
| 678730 | 9/1952 | United Kingdom | 383/20 |
| 786327 | 11/1957 | United Kingdom | 383/20 |
| 793053 | 4/1958 | United Kingdom | 383/14 |
| 1157112 | 7/1969 | United Kingdom | 383/20 |
| 1341838 | 12/1973 | United Kingdom | 383/20 |

*Primary Examiner*—Allan N. Shoap
*Assistant Examiner*—Christopher McDonald
*Attorney, Agent, or Firm*—Dick and Harris

[57] ABSTRACT

An extensible handle bag apparatus capable of being manufactured on conventional high-speed manufacturing equipment, wherein the handles of the bag apparatus are constructed from an extensible material which provide comfort to a person's hands when carrying the apparatus, as well as which provide substantial load carrying capabilities to the bag itself. One or more extensible handles are attached in a retracted position below the top peripheral edge of the bag until the handles are manually deployed by an individual making initial use of the fully constructed apparatus. The handles comprise a gripping member and two leg members operably attached to the gripping member. The handles further include attachment regions which are initially stretched, independent of the remainder of the handles so as to increase the surface area for adherence directly to the bag itself and/or to corresponding handle attachment patches.

14 Claims, 1 Drawing Sheet

Fig 1
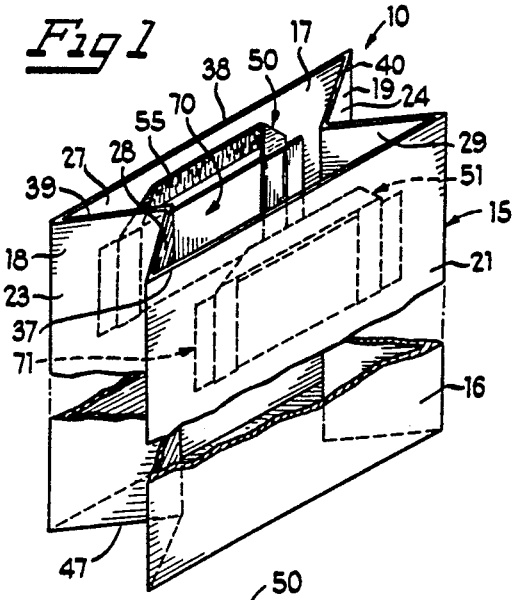
Fig 2
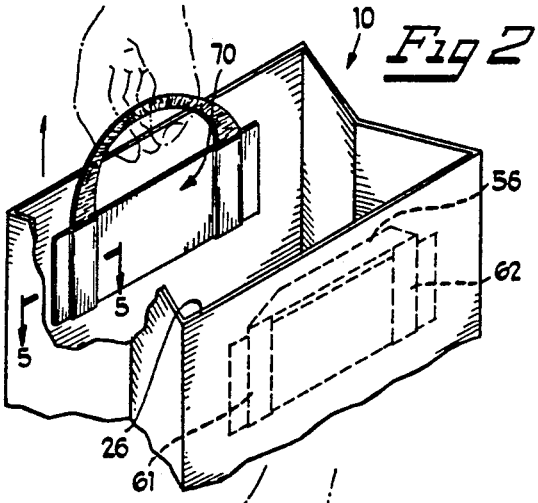
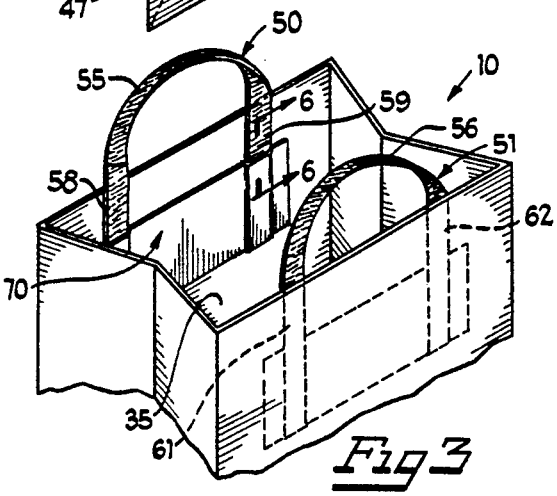
Fig 3
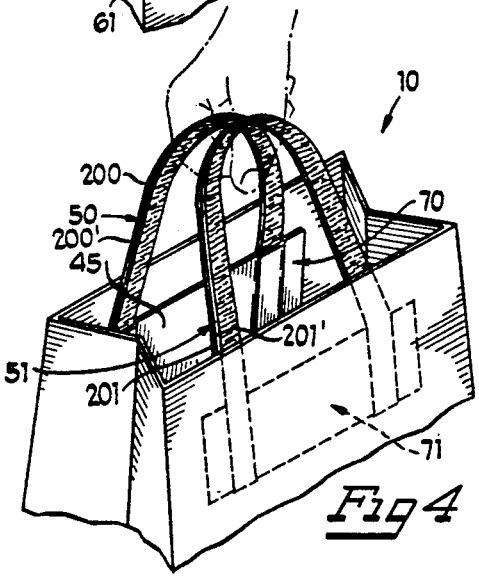
Fig 4
Fig 5
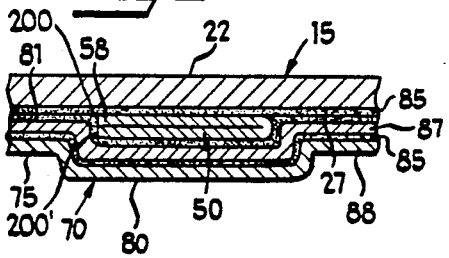
Fig 6
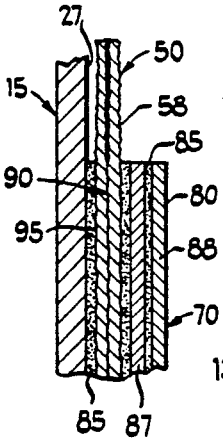
Fig 7
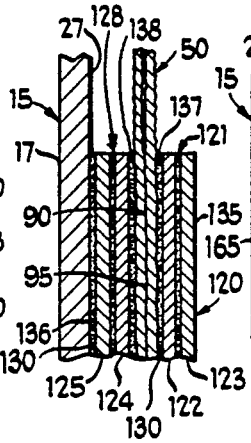
Fig 8
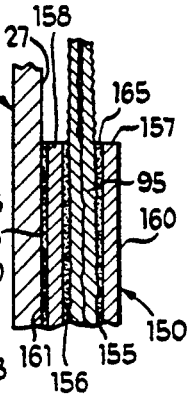

EXTENSIBLE HANDLE BAG APPARATUS

BACKGROUND OF THE INVENTION

The present invention relates to carrying bags with handles and, more particularly, to an extensible handle bag apparatus capable of manufacture on high-speed manufacturing equipment, wherein the handles of the bag are made from an extensible material which provide comfort to a person's hands when carrying the apparatus, as well as which provide substantial load carrying capabilities to the apparatus itself.

Bags manufactured with handles have been known in the art for many, many years. Many of these bags have utilized carrier members, or patches of material for binding the handles to the inside, or outside, surfaces of the bag. Examples of such prior art can be found in Winesett, U.S. Pat. No. 2,469,536; Steen, U.S. Pat. No. 2,838,224; and Class, U.S. Pat. No. 3,439,591.

Although such prior art have been functionally satisfactory, they have, in many cases, been found to be uncomfortable to a person's hands when carrying relatively heavy loads for an extended period of time—due primarily to the handle configuration and type of material used for the handles. Additionally, inasmuch as such handles have not been intended for manual extensible deployability after the bag is manufactured, they have been attached to the bag during the manufacturing process in such a way where at least a portion of the handle actually extends above and past the top peripheral edge of the bag itself—thus precluding the ability for the bag to be manufactured on high-speed equipment.

Accordingly, few if any of the prior art bags teach, much less disclose, a bag having an extensible handle which is attached and maintained below the top peripheral edge of the bag, during and after the manufacture—thereby facilitating relatively high-speed manufacturing of the apparatus. Indeed, inasmuch as at least a portion of the handles in the prior art are positioned above the upper peripheral edges of the web of bag material, the likelihood of the handles causing a jam, or other form of manufacturing malfunction (due to otherwise protruding handle members) during the cutting of web of bag material, or any other step of manufacturing, is often realized. Furthermore, few, if any of such prior art devices disclose an extensible handle which has only the attachment regions (where the handle is affixed either to the bag directly, or to handle patches) stretched independently of the remainder of the handles so as to increase the surface area for better adherence to the bag and/or patch of material.

Additionally, while prior art, such as Baron, Great Britain Specification No. 786,327, does disclose the use of extensible material for use as handles for a bag, such handles are not intended to be manually stretched from a retracted position below the top peripheral edge of the fully assembled bag, to a fully deployed position upon initial use of the bag by an individual. Indeed, such prior art discloses that such handles are stretched during the manufacturing process and then maintained in such a stretched position thereafter—thereby precluding high speed manufacture, as well as precluding individual formability of the handles to a respective individuals hands.

It is thus an object of the present invention to provide an extensible handle bag apparatus which can utilize an extensible handle attached and maintained below the top peripheral edge of the fully assembled bag during the manufacturing of same so as to facilitate manufacturing of the apparatus on high speed manufacturing equipment.

It is also an object of the present invention to provide an extensible handle bag apparatus which has the attachment regions of the extensible handles pre-stretched during the manufacturing of same so as to increase the surface area for maximized adherence to the bag material itself and/or to corresponding handle attachment patches, while maintaining the remainder of the handles in a retracted position below the top peripheral edge of the assembled bag apparatus.

It is still further an object of the present invention to provide an extensible handle bag apparatus having handles which are stretchably extended up and past the top peripheral edge of the fully assembled bag apparatus by manual deployability by an individual upon initial use of the extensible handle bag apparatus and, which are then substantially maintained in their stretched deployed state after such initial use.

It is yet another object of the present invention to provide an extensible handle bag apparatus which utilizes an extensible handle which is comfortable to the hands of the individual carrying the extensible handle bag apparatus when the bag itself is supporting a load therewithin, and wherein such extensible handles improve the load carrying capabilities of the apparatus, which, in turn, reduces the likelihood of severing the bag at or near the handle attachment regions during such use.

These and other objects of the present invention will become apparent in light of the present specification, claims and drawings.

SUMMARY OF THE INVENTION

The present invention comprises an extensible handle bag apparatus capable of fabrication on high-speed manufacturing equipment. The apparatus includes handle elements which can be maintained in a wholly unobtrusive retracted position within a bag article, for facilitating comfort to an individual's hands when utilizing the handle elements in a deployed orientation, as well as for providing substantial load carrying capabilities to said apparatus, thereby reducing the likelihood of severing the handle elements, the bag article or the connection therebetween when the apparatus is being used to contain a load of articles. Bag means are provided for operably housing and supporting the load of articles. The bag means have front panel means and opposing back panel means, each having substantially planar exterior surfaces which define an interior region. Each of the front and back panel means have a top peripheral edge which define an aperture for .enabling the passage of the articles into the interior region and a substantially sealed bottom end for precluding the inadvertent release of the articles positioned within the interior region.

A pair of handle means, which may have a substantially inverted U-shaped configuration, are constructed from an extensible and substantially non-retractable material, with at least one of the pairs of handle means being operably attached to the planar interior surfaces of each of the front and back panel means, respectively. It is preferred that the extensible material for the handles comprise creped paper, although, any other type of commercially available material providing extensible and substantially non-retractable characteristics, which would also be comfortable to a user's hands, is also contemplated for use. Each of the handle means have a gripping member and two leg members emanating from the opposite ends of the gripping member so as to be in substantially parallel relationship thereto so as to minimize the thickness of each of the one or more handle means, to in turn, reduce protrusion of the one or more handle means during the high-speed manufacture of the apparatus itself.

Each pair of handle means are operably and wholly positioned adjacent to and below the top peripheral edge of at least the front and back panel means in a retracted position below the top peripheral edge of the bag means. Furthermore, the handle means are capable of manipulation from their retracted position to a fully deployed substantially elongated inverted U-shaped load carrying position with the U-shaped gripping means positioned above the top peripheral edge of the bag. Although the material used for the handle means is extensible, once extended, the material will not recover back to its retracted position. Accordingly, the handles will be substantially maintained in their substantially elongated inverted U-shaped configuration after deployment.

In the preferred embodiment of the invention, at least one of the two leg members of each of the pairs of handle means further includes one or more attachment contact means for operable securement to a portion of the bag means. The one or more attachment contact means comprise at least one of the two leg members having at least one stretched region so as to result in a maximized surface area for operable, preferably adhesive attachment, to a portion of the bag means. While such attachment contact means may be secured to the bag means by any suitable commercially available adhesive, other types of securement means, such as staples or stitching, among others, are also contemplated for use.

In another preferred embodiment of the invention, the extensible handle bag apparatus further includes handle carrier means for operably and preliminarily attaching at least a portion of at least one of the pairs of handle means, for subsequent attachment to the bag means. Accordingly, the stretched regions of the leg members are operably secured to a portion of the handle carrier means.

The handle carrier means may comprise a single patch of sheet material having a front surface and a bag contact surface for attachment to a portion of the bag means. Accordingly, the bag contact surface of the patch of material and the bag means will sandwich substantially all of the stretched regions of the leg members of the handle means therebetween. Once again, such securement may be maintained by adhesive.

In another preferred embodiment of the invention, the handle carrier means comprises two patches of material each having an exterior surface and an interior surface for operable attachment to substantially all of the stretched portions of the leg members of a respective pair of handle means. The stretched portions of the leg members are operably sandwiched and secured between the interior surfaces of the two patches of material. Accordingly, one of the exterior surfaces of the two patches of material is then operably attached to a portion of the bag means to, in turn, secure the respective pair of handle means to the bag means as well.

BRIEF DESCRIPTION OF THE DRAWINGS

FIG. 1 of the drawings is a perspective view of the present extensible handle bag apparatus showing, in particular, the handle carrier means and the substantially retracted positioning of the handle means positioned below the top peripheral edge of the bag means;

FIG. 2 of the drawings is a cut-away perspective view of the extensible handle bag apparatus of FIG. 1 showing, in particular, the partially stretched deployment of one of the handle means above and beyond the top peripheral edge of the bag means;

FIG. 3 of the drawings is a cut-away view of the present extensible handle bag apparatus showing, in particular, the leg members and gripping portions of the handle means after they have been partially deployed and, in turn, stretched, into a substantially elongated inverted U-shaped configuration;

FIG. 4 of the drawings is a cut-away perspective view of the present extensible handle bag apparatus showing, in particular, the fully deployed and stretched handle means which have been extended into a substantially elongated inverted U-shaped configuration;

FIG. 5 of the drawings is a partial, cross-sectional view of the extensible handle bag apparatus of FIG. 2, taken along lines 5—5 and looking in the direction of the arrows, showing, in particular, a double plied single patch handle carrier means construction, as well as the positioning of the stretched region of one of the leg members of the handle means sandwiched between the bag contact surface of the handle carrier means and the interior surface of the bag means;

FIG. 6 of the drawings is a partial, cross-sectional view of the extensible handle bag apparatus of FIG. 3, taken along lines 6—6 and looking in the direction of the arrows, showing, in particular, the stretched region of one of the leg members operably positioned between the handle carrier means and the interior surface of the bag means, as well as showing the partially deployed and stretched remainder of the leg member;

FIG. 7 of the drawings is a partial cross-sectional side view of the extensible handle bag apparatus, showing in particular, the operable positioning of the stretched region of one of the leg members between the interior surfaces of two adjacently positioned patches of material, as well as showing the double-ply construction of both of the patches which collectively embody the handle carrier means; and FIG. 8 of the drawings is a partial cross-sectional side view of the extensible handle bag apparatus, showing in particular, the operable positioning of the stretched region of one of the leg members between the interior surfaces of the two adjacently positioned patches of material, as well as showing the single-ply construction of both of the patches which collectively embody the handle carrier means.

DETAILED DESCRIPTION OF THE DRAWINGS

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Extensible handle bag apparatus 10 is shown in FIG. 1 as comprising bag means 15, handle means 50 and 51

(which are shown as having a substantially inverted U-shaped configuration) and handle carrier means 70 and 71. Bag means 15 includes front panel means 16, back panel means 17, and two side panels 18 and 19. Although these side panels are constructed with gussets, non-gusseted side panels, as well as the elimination of side panels are also contemplated and embraced by the invention. Front panel means 16, back panel means 17 and side panel means 18 and 19 each have an exterior surface, 21, 22 (FIG. 5), 23 and 24 respectively, an interior surface 26 (FIG. 2), 27, 28 and 29, respectively, which define interior region 35 (FIG. 3), a top peripheral edge 37, 38, 39 and 40, respectively, which define aperture 45 (FIG. 4), and sealed bottom end 47.

Substantially inverted U-shaped handle means 50 and 51 are shown in FIGS. 1 through 3 as each including gripping members 55 and 56 (FIG. 2 and FIG. 3) respectively, and two leg members 58 and 59, and 61 and 62, respectively, which depend from the gripping members. Leg members, 58, 59 and 61, 62 each have attachment contact means, such as attachment contact means 90, as shown in FIG. 6, which comprise stretched regions, such as stretched region 95 of the extensible material. These stretched regions serve to maximize the otherwise limited portion of exposed surface area of the leg members, for attachment to a corresponding portion of the bag contact surface of the handle carrier means, such as handle carrier means 70, as well as for attachment to the interior surface, such as interior surface 27, of bag means 15, as shown in detail in FIG. 6. Additionally, the stretched regions are stretched independently of the remainder of the handle means 50 and 51, thereby enabling the remainder of leg members 58, 59, 61 and 62, as well as the respective gripping members 55 and 56 to be positioned, as well as operably maintained, in a retracted position below the top peripheral edges 37 through 40 of bag means 15 during the manufacture of extensible handle bag apparatus 10, as well as prior to actual use of the fully manufactured apparatus, as shown in FIG. 1. Such a maintained retracted position effectively facilitates the high-speed manufacturing of the apparatus inasmuch as the handles will not extend out beyond the peripheral edges of what will become bag means 15—thereby reducing the likelihood for any protruding portion of the handle means to become entangled on components of the bag-making machinery, which could otherwise result in a machine jam.

As shown in FIG. 5, handle means 50 can be constructed from one piece of extensible material which is folded over itself without the opposed side ends 200, 200', 201, 201' (FIG. 4) of the handle means 50 and 51, respectively, being physically attached to each other. Although such a folded over construction is shown, a non-folded single ply construction is also contemplated.

Handle carrier means, such as handle carrier means 70, is shown in FIG. 5 and FIG. 6 as comprising a single patch of material, such as material patch 75. Each such patch of material includes a front surface, such as front surface 80, and a bag contact surface 81, (FIG. 5), positioned opposite to the front surface 80. Adhesive 85 (FIG. 5) is operably applied between the bag contact surface of the patch of material 81 and the corresponding interior surface 27 of bag 15. Such adhesive secures the patch to the bag while securing the respective stretched regions of the leg members sandwiched between the patch and the bag. Furthermore, the single patch of handle carrier material may comprise a single or multiple ply construction, such as first ply 87 and second ply 88. Where a multi-ply construction is utilized, adhesive such as adhesive 85, may be used to secure the plies together—although other types of commercially available securement means for the plies may be used.

Extensible handle bag apparatus 10 is shown in FIG. 3 and FIG. 4 after substantially inverted U-shaped handle means 50 and 51 have been extended from their retracted position, as shown in FIG. 1, towards and into their fully deployed elongated load carrying position, as shown in FIG. 4. Deployment of handle means 50 and 51 by a user of apparatus 10 is achieved by merely grasping the gripping members, such as gripping member 55 (typically after articles have been positioned within bag means 15), and then pulling the gripping members upwardly in the direction of the arrow, as shown in FIG. 2. Inasmuch as the material of handle means 50 and 51 is made of a low or non-memory extensible material, such as creped paper, the gripping members, such as gripping member 55, as well as its leg members 58 and 59, will stretch out into a substantially U-shaped configuration upon deployment. However, although the gripping members will stretch, the previously stretched regions, such as stretched region 95 (FIG. 6), of the leg members, will remain relatively unaffected during the extensible deployment of the remainder of the handle means, having been stabilized through adhesive attachment to bag 15. After the handle means have been deployed, they will not retract back into their pre-stretched configuration.

The extensible material used for constructing handle means 50 and 51 not only facilitates extensible deployment of handle means 50 and 51, but it also serves the added benefit of providing comfort to a user's hands when an individual is carrying bag means 15 by handle means 50 and 51. In addition, such extensible material, and its means of attachment to the bag, enable apparatus 10 to support relatively heavy loads within bag means 15 without substantial risk of severing a portion of handle means 50 and 51, bag means 15, and/or handle carrier means 70 and 71 (FIG. 4) as extensible handle bag apparatus is being toted by handle means 50 and 51. While reinforced creped paper may be used for handle means 50 and 51, other types of commercially available material which possesses extensible and substantially non-retractable characteristics are also contemplated for use.

Two alternative variations of the handle carrier means are shown in FIGS. 7 and 8. In particular, handle carrier means 120 is shown in FIG. 7 as comprising two patches of material 121 and 128. Each patch of material is constructed from two plies of paper material 122 and 123, and, 124 and 125, respectively. Patch 121 and 128 each have an exterior surface 135 and 136 and an interior surface 137 and 138. Interior surfaces 137 and 138 are adjacently positioned to each other and attached to each other by adhesive 130. Accordingly, stretched region 95 of attachment contact means, such as attachment contact means 90, is sandwiched between the interior surfaces of the patches and secured thereto by the adhesive. One of the exterior surfaces, such as exterior surface 136 of patch 128 is operably secured to interior surface, such as interior surface 27, of one of the panels, such as back panel means 17, of bag means 15, by adhesive 130 so as to attach handle carrier means 120 and, in turn, the handle means, such as handle means 50, to bag means 15. Although adhesive may be used for such attachment as well as for securement of stretched region 95 between the patches of material 121 and 128, other means of attachment, such as by staples and/or threaded stitching, for example, are also contemplated for use.

Handle carrier means 150 is shown in FIG. 8 as comprising two patches of material 157 and 158, each of which is constructed from a single ply of paper material. Each ply of material includes an interior surface 155 and 156 and an exterior surface 160 and 161. Accordingly, stretched region 95 of the leg members are sandwiched between the interior surfaces and secured thereto by adhesive 165. Also shown in FIG. 8 is the attachment of exterior surface 161 of patch 158 to interior surface 27 of bag means 15 by adhesive 165.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An extensible handle bag apparatus, capable of fabrication on high-speed bag manufacturing equipment, having handle elements which can be maintained in either a wholly unobtrusive unextended retracted position within a bag article, or in an extended deployed position for facilitating comfort to an individual's hands when utilizing the handle elements, as well as for providing substantial load carrying handle capabilities to said apparatus, thereby reducing the likelihood of severing the handle elements from the bag apparatus when it is being used to carry a load of articles, said extensible handle bag apparatus comprising:

bag means for operably housing and supporting said load of articles, said bag means having a front panel and an opposing back panel, each having substantially planar exterior surfaces, and substantially planar interior surfaces opposite said exterior surface, and defining an interior region, each of said front and back panels having an uppermost substantially linear top peripheral edge defining an aperture for enabling the passage of said articles into said interior region, and a substantially sealed bottom end for precluding the inadvertent release of said articles positioned within said interior region; and a pair of handle means for facilitating carrying of said bag means, each of said handle means being constructed from an extensible and substantially non-retractable material with one of said pair of handle means operable attached to the substantially planar interior surfaces of each of said front and back panels respectively, each of said handle means being capable of yielding in at least a direction which allows said material to be substantially linearly extensible toward and into a fully deployed substantially elongated inverted U-shaped load carrying position, each of said unextended handle means having a gripping member having a top peripheral edge, opposite ends and two leg members emanating from the opposite ends of said gripping member, so as to be in substantially parallel relationship therewith, so as to minimize the thickness of said pair of handle means, to in turn, reduce protrusion of said pair of handle means during said high speed manufacture of said extensible handle bag apparatus, said pair of handle means being operably and wholly positioned adjacent to and below said uppermost substantially linear top peripheral edge of at least said front panel and said back panel in a substantially retracted position below said uppermost substantially linear top peripheral edge of said bag means prior to said handle means yielding in said at least a direction which allows said material to be extensible, said pair of handle means each having a substantially inverted U-shaped orientation when in said substantially retracted position, wherein said top peripheral edge of said gripping members are positioned above each corresponding leg member, in a position more proximate than said leg members to said top peripheral edge of said bag means, said pair of handle means being capable of linear extensibility from said substantially retracted U-shaped orientation below said uppermost substantially linear top peripheral edge of said bag means to said fully deployed substantially elongated inverted U-shaped load carrying position as a function of the direction of extensibility of the material, with said gripping member positioned above said uppermost substantially linear top peripheral edge of said bag means and, in turn, said handle means being substantially maintained in a substantially elongated inverted U-shaped configuration after said deployment.

2. The invention according to claim 1 in which the extensible handle bag apparatus further includes handle carrier means for operably attaching at least a portion of at least one of said pair of handle means to said bag means.

3. The invention according to claim 1 in which at least a portion of each of said pair of handle means are constructed from creped material.

4. An extensible handle bag apparatus, capable of fabrication on high-speed bag manufacturing equipment, having handle elements which can be maintained in either a wholly unobtrusive unextended, retracted position within a bag article, or in an extended deployed position for facilitating comfort to an individual's hands when utilizing the handle elements, as well as for providing substantial load carrying handle capabilities to said apparatus, thereby reducing the likelihood of severing the handle elements from the bag apparatus when it is being used to carry a load of articles, said extensible handle bag apparatus comprising:

bag means for operably housing and supporting said load of articles, said bag means having a front panel and an opposing back panel, each having substantially planar exterior surfaces, and substantially planar interior surfaces opposite said exterior surface, and defining an interior region, each of said front and back panels having an uppermost substantially linear top peripheral edge defining an aperture for enabling the passage of said articles into said interior region, and a substantially sealed bottom end for precluding the inadvertent release of said articles positioned within said interior region; and a pair of handle means for facilitating carrying of said bag means, each of said handle means being constructed from an extensible and substantially non-retractable material with one of said pair of handle means operably attached to the substantially planar interior surfaces of each of said front and back panels respectively, each of said handle means being capable of yielding in at least a direction which allows said material to be extensible toward and into a fully deployed substantially elongated inverted U-shaped load carrying position, each of said unextended handle means having a gripping member having opposite ends and two leg members emanating from the opposite ends of said gripping member, so as to be in substantially parallel relationship therewith, so as to minimize the thickness of said pair of handle means, to in turn, reduce protrusion of said pair of handle means during said high speed manufacture of said extensible handle bag apparatus, said pair of handle means being operably and wholly positioned adjacent to and below said uppermost substantially linear top peripheral edge of at least said front panel and said back panel in a substantially retracted position below said uppermost substantially linear top peripheral edge of said bag means prior to said handle means yielding in said at least a direction which allows said material to be extensible, said pair of handle means being capable of manipulation from said substantially retracted position below said uppermost substantially linear to peripheral edge of said bag means to said fully deployed substantially elongated inverted U-shaped load carrying position as a function of the direction of extensibility of the material, with said gripping member positioned above said uppermost substantially linear top peripheral edge of said bag means and, in turn, said handle means being substantially maintained in a substantially elongated inverted U-shaped configuration after said deployment;

at least one of said two leg members of each of said pair of handle means further include at least one attachment contact means for operable securement to a portion of said bag means, said at least attachment contact means comprising at least one of said two leg members having at least one stretched region so as to result in a maximized surface area for operable attachment to a portion of said bag means.

5. The invention according to claim 4 in which said at least two leg members of each of said at least one handle means comprises at least one stretched region.

6. The invention according to claim 5 in which said at least one attachment contact means are secured to said bag means by adhesive.

7. An extensible handle bag apparatus, capable of fabrication on high-speed bag manufacturing equipment, having handle elements which can be maintained in either a wholly unobtrusive unextended, retracted position within a bag article, or in an extended deployed position for facilitating comfort to an individual's hands when utilizing the handle elements, as well as for providing substantial load carrying handle capabilities to said apparatus, thereby reducing the likelihood of severing the handle elements from the bag apparatus when it is being used to carry a load of articles, said extensible handle bag apparatus comprising:

bag means for operably housing and supporting said load of articles, said bag means having a front panel and an opposing back panel, each having substantially planar exterior surfaces, and substantially planar interior surfaces opposite said exterior surface, and defining an interior region, each of said front and back panels having an uppermost substantially linear top peripheral edge defining an aperture for enabling the passage of said articles into said interior region, and a substantially sealed bottom end for precluding the inadvertent release of said articles positioned within said interior region;

a pair of handle means for facilitating carrying of said bag means, each of said handle means being constructed from an extensible and substantially non-retractable material with one of said pair of handle means operably attached to the substantially planar interior surfaces of each of said front and back panels respectively, each of said handle means being capable of yielding in at least a direction which allows said material to be extensible toward and into a fully deployed substantially elongated inverted U-shaped load carrying position, each of said unextended handle means having a gripping member having opposite ends and two leg members emanating from the opposite ends of said gripping member, so as to be in substantially parallel relationship therewith, so as to minimize the thickness of said pair of handle means, to in turn, reduce protrusion of said pair of handle means during said high speed manufacture of said extensible handle bag apparatus, said pair of handle means being operably and wholly positioned adjacent to and below said uppermost substantially linear top peripheral edge of at least said front panel and said back panel in a substantially retracted position below said uppermost substantially linear top peripheral edge of said bag means prior to said handle means yielding in said at least a direction which allows said material to be extensible, said pair of handle means being capable of manipulation from said substantially retracted position below said uppermost substantially linear top peripheral edge of said bag means to said fully deployed substantially elongated inverted U-shaped load carrying position as a function of the direction of extensibility of the material, with said gripping member positioned above said uppermost substantially linear top peripheral edge of said bag means and, in turn, said handle means being substantially maintained in a substantially elongated inverted U-shaped configuration after said deployment; and said extensible handle bag apparatus further including handle carrier means for operably attaching at least a portion of at least one of said pair of handle means to said bag means, at least one of said two leg members of each of said pair of handle means further include at least one attachment contact means for operable securement to a portion of said handle carrier means, at least one attachment contact means comprising at least one of said two leg members having at least one stretched region so as to result in a maximized surface area for operable attachment to said handle carrier means.

8. The invention according to claim 7 in which said handle carrier means comprises a patch of material having a front surface and a bag contact surface for attachment to a portion of said bag means, said bag contact surface of said patch of material and said bag means cooperating to sandwich substantially all of said stretched regions of said leg members of said handle means therebetween.

9. The invention according to claim 7 in which said handle carrier means comprises two patches of material each having an exterior surface and an interior surface for operable attachment to substantially all of said stretched portions of said leg members of each one of said pair of handle means, said stretched portions of said leg members being operably sandwiched and secured between said interior surfaces of said two patches of material, and one of said exterior surfaces of said two patches of material being operably attached to a portion of said bag means to, in turn, secure said pair of handle means thereto.

10. The invention according to claim 9 in which each of said interior surfaces of said two patches of material are secured to each other, and, in turn, to said stretched portions of said leg members by adhesive means, and said one of said exterior surfaces of said two patches of material being attached to said bag means by adhesive means.

11. The invention according to claim 9 in which each of said handle carrier means are attached to a portion of said interior surface of said bag means.

12. The invention according to claim 7 in which said handle carrier means are attached to said interior surface of said bag means.

13. An extensible handle bag apparatus, capable of fabrication on high-speed bag manufacturing equipment, having handle elements which can be maintained in either a wholly unobtrusive unextended, retracted position within a bag article, or in an extended deployed position for facilitating comfort to an individual's hand when utilizing the handle elements, as well as for providing substantial load carrying handle capabilities to said apparatus, thereby reducing the likelihood of severing the handle elements from the bag apparatus when it is being used to carry a load of articles, said extensible handle bag apparatus comprising:

bag means for operably housing and supporting said load of articles, said bag means having a front panel and an opposing back panel, each having substantially planar exterior surfaces, and substantially planar interior surfaces opposite said exterior surface, and defining an interior region, each of said front and back panels having an uppermost substantially linear top peripheral edge substantially defining an aperture for enabling the passage of said articles into said interior region, and a substantially sealed bottom end for precluding the inadvertent release of said articles positioned within said interior region;

a pair of handle means for facilitating carrying of said bag means, each of said handle means being constructed from an extensible and substantially non-retractable material with one of said pair of handle means operably attached to the substantially planar interior surfaces of each of said front and back panels respectively, each of said unextended handle means having a gripping member having opposite ends and two leg members emanating from the opposite ends of said gripping member, so as to be in substantially parallel relationship therewith, so as to minimize the thickness of said pair of handle means, to in turn, reduce protrusion of said pair of handle means during said high speed manufacture of said extensible handle bag apparatus, said pair of handle means being operably and wholly positioned adjacent to and below said uppermost substantially linear top peripheral edge of at least said front panel and said back panel in a substantially retracted position below said uppermost substantially linear top peripheral edge of said bag means, said pair of handle means being capable of manipulation from said substantially retracted position below said uppermost substantially linear top peripheral edge of said bag means to said fully deployed substantially elongated inverted U-shaped load carrying position as a function of the extensibility of the material, with said gripping member positioned above said uppermost substantially linear to peripheral edge of said bag means and, in turn, said handle means being substantially maintained in a substantially elongated inverted U-shaped configuration after said deployment; and at least one of said two leg members of each of said pair of handle means including at least one attachment contact means for operable securement to a portion of said bag means, said at least one attachment contact means comprising at least one of said two leg members having at least one stretched region so as to result in a maximized surface area for operable attachment to a portion of said bag means.

14. An extensible handle bag apparatus, capable of fabrication on high-speed bag manufacturing equipment, having handle elements which can be maintained in either a wholly unobtrusive unextended, retracted position within a bag article, or in an extended deployed position for facilitating comfort to an individual's hands when utilizing the handle elements, as well as for providing substantial load carrying handle capabilities to said apparatus, thereby reducing the likelihood of severing the handle elements from the bag apparatus when it is being used to carry a load of articles, said extensible handle bag apparatus comprising:

bag means for operably housing and supporting said load of articles, said bag means having a front panel and an opposing back panel, each having substantially planar exterior surfaces, and substantially planar interior surfaces opposite said exterior surface, and defining an interior region, each of said front and back panels having an uppermost substantially linear top peripheral edge substantially defining an aperture for enabling the passage of said articles into said interior region, and a substantially sealed bottom end for precluding the inadvertent release of said articles positioned within said interior region; and a pair of handle means for facilitating carrying of said bag means, each of said handle means being constructed from an extensible and substantially non-retractable corrugated material with one of said pair of handle means operably attached to the substantially planar interior surfaces of each of said front and back panels respectively, said corrugated material being orientated in a direction which facilitates yielding of said handle means in at least a direction which allows said handle means to be linearly extensible toward and into a fully deployed substantially elongated inverted U-shaped load carrying position, each of said unextended handle means having a gripping member having a top peripheral edge, opposite ends and two leg members emanating from the opposite ends of said gripping member, so as to be in substantially parallel relationship therewith, so as to minimize the thickness of said pair of handle means, to in turn, reduce protrusion of said pair of handle means during said high speed manufacture of said extensible handle bag apparatus, said pair of handle means being operably and wholly positioned adjacent to and below said uppermost substantially linear top peripheral edge of at least said front panel and said back panel in a substantially retracted position below said uppermost substantially linear top peripheral edge of said bag means, said pair of handle means each having a substantially inverted U-shaped orientation when in said substantially retracted position, wherein said top peripheral edge of said gripping members are positioned above each corresponding leg member, in a position more proximate than said leg members to said top peripheral edge of said bag means, said pair of handle means being capable of linear extensibility from said substantially retracted U-shaped orientation position below said uppermost substantially linear top peripheral edge of said bag means to said fully deployed substantially elongated inverted U-shaped load carrying position as a function of the direction of the extensibility of the corrugated material, with said gripping member positioned above said uppermost substantially linear top peripheral edge of said bag means and, in turn, said handle means being substantially maintained in said substantially elongated inverted U-shaped configuration after said deployment.

* * * * *

UNITED STATES PATENT AND TRADEMARK OFFICE

CERTIFICATE OF CORRECTION

PATENT NO. : 5,328,266

DATED : July 12, 1994

INVENTOR(S) : TOMMY LEE DAVIS

It is certified that error appears in the above-identified patent and that said Letters Patent is hereby corrected as shown below:

| | |
|---|---|
| Col. 7 line 27 | After "unextended" insert -- , --. |
| Col. 7 line 54 | Delete "operable" and insert instead -- operably --. |
| Col. 7 line 57 | "each of said handle means ..." should be in a new paragraph |
| Col. 9 line 32 | Delete "to" and insert instead -- top --. |
| Col. 9 line 53 | Delete "comprises" and insert instead -- comprise --. |
| Col. 10 line 66 | Before "at least" insert -- said --. |

Signed and Sealed this

Sixth Day of December, 1994

*Attest:*

*Attesting Officer*

Bruce Lehman

BRUCE LEHMAN

*Commissioner of Patents and Trademarks*